United States Patent [19]

LaBounty

[11] 4,248,471

[45] Feb. 3, 1981

[54] BACKHOE GRAPPLE ASSEMBLY

[76] Inventor: Roy E. LaBounty, 1607 Eighth Ave., Two Harbors, Minn. 55616

[21] Appl. No.: 76,220

[22] Filed: Sep. 17, 1979

[51] Int. Cl.[3] ..... B66C 3/16

[52] U.S. Cl. ..... 294/88; 294/106; 414/739

[58] Field of Search ..... 294/88, 68, 69, 104, 294/105, 106; 414/734, 738, 741, 739, 740; 39/183 R, 184, 186, 189

[56] References Cited

U.S. PATENT DOCUMENTS

| | | | |
|---|---|---|---|
| 3,125,234 | 3/1964 | Gustine | 414/739 |
| 3,802,731 | 4/1974 | LaBounty | 294/88 |
| 4,005,894 | 2/1977 | Tucek | 294/106 |

*Primary Examiner*—James B. Marbert
*Attorney, Agent, or Firm*—H. Dale Palmatier

[57] ABSTRACT

An arcuate-shaped upper jaw is pivotally attached near its inner end to the outer end of the stick member extending from the boom assembly of a backhoe, and an arcuate-shaped lower jaw is pivotally connected to the inner end of the upper jaw, the lower jaw further being pivotally connected by means of a rod or a hydraulic cylinder to the underside of the stick member. A double-acting hydraulic cylinder disposed on the stick member causes movement of the upper jaw, which thereby effects movement of the lower jaw, such that the jaws can be moved together for clamping or apart for a raking operation by the lower jaw.

6 Claims, 2 Drawing Figures

BACKHOE GRAPPLE ASSEMBLY

BACKGROUND OF THE INVENTION

This invention relates to backhoes, and, more particularly, to an improved grapple assembly for backhoes.

Bulldozers, front end loaders and trucks have long been used for roadwork, clearing brush, and demolition of condemned buildings. More recently, a grapple assembly for a backhoe boom was developed and has proved extremely valuable for a variety of uses, especially for building demolition. Such backhoe assembly, disclosed in U.S. Pat. No. 3,802,731, has a pivotal upper jaw and a fixed lower jaw, and can be used for both crushing and raking of debris.

Material handling devices have been developed for carrying of bulky objects, such as logs and large stones. One such device, disclosed in U.S. Pat. No. 3,034,820 has an improved clamping fork formed of two movable arms, with actuating means for each arm. Other grapple and loading devices are disclosed in U.S. Pat. Nos. 2,776,768; 2,883,230; 3,152,706; 3,227,297; 3,567,050; and 3,517,960.

SUMMARY OF THE INVENTION

In accordance with this invention, there has been provided an improved grapple assembly for backhoes, comprising an arcuate shaped upper jaw pivotally attached near its inner end to the forwardly extending stick member of the backhoe, an arcuate shaped lower jaw pivotally mounted on the stick member and operably connected to the upper jaw for effecting downward and upward pivotal movement of the lower jaw. Operation of the hydraulic means to move the upper jaw in either direction about its pivot point of connection to the stick member causes pivotal movement of the lower jaw at its point of connection to the upper jaw, such that both jaws can be moved together to effect a clamping action, or apart for release of debris. The means for pivotally connecting the lower jaw to the stick member preferably comprises either an adjustable rod pivotably connected at either end to the stick member and lower jaw respectively, or a double-acting hydraulic cylinder and piston rod, also disposed between the stick member and lower jaw.

It is a primary object of this invention to provide a backhoe grapple assembly capable of clamping action, such that debris can be picked up close to the excavator, together with a lower jaw that can be positioned by movement of the upper jaw for improved raking and gathering operations.

It is a further object of this invention to provide an improved grapple assembly for allowing piling of debris at greater height, due to superior dumping ability of the lower jaw.

It is a further object of this invention to provide an improved grapple assembly wherein the lower jaw can be positioned at the most desirable raking angle and held in such position during the raking operation.

It is another object of this invention to provide a grapple assembly having an improved flexibility for biting into a building to be demolished, and for raking, gathering, pick up, and crushing of debris from a demolished building.

DESCRIPTION OF THE PREFERRED EMBODIMENT

Figure 1:
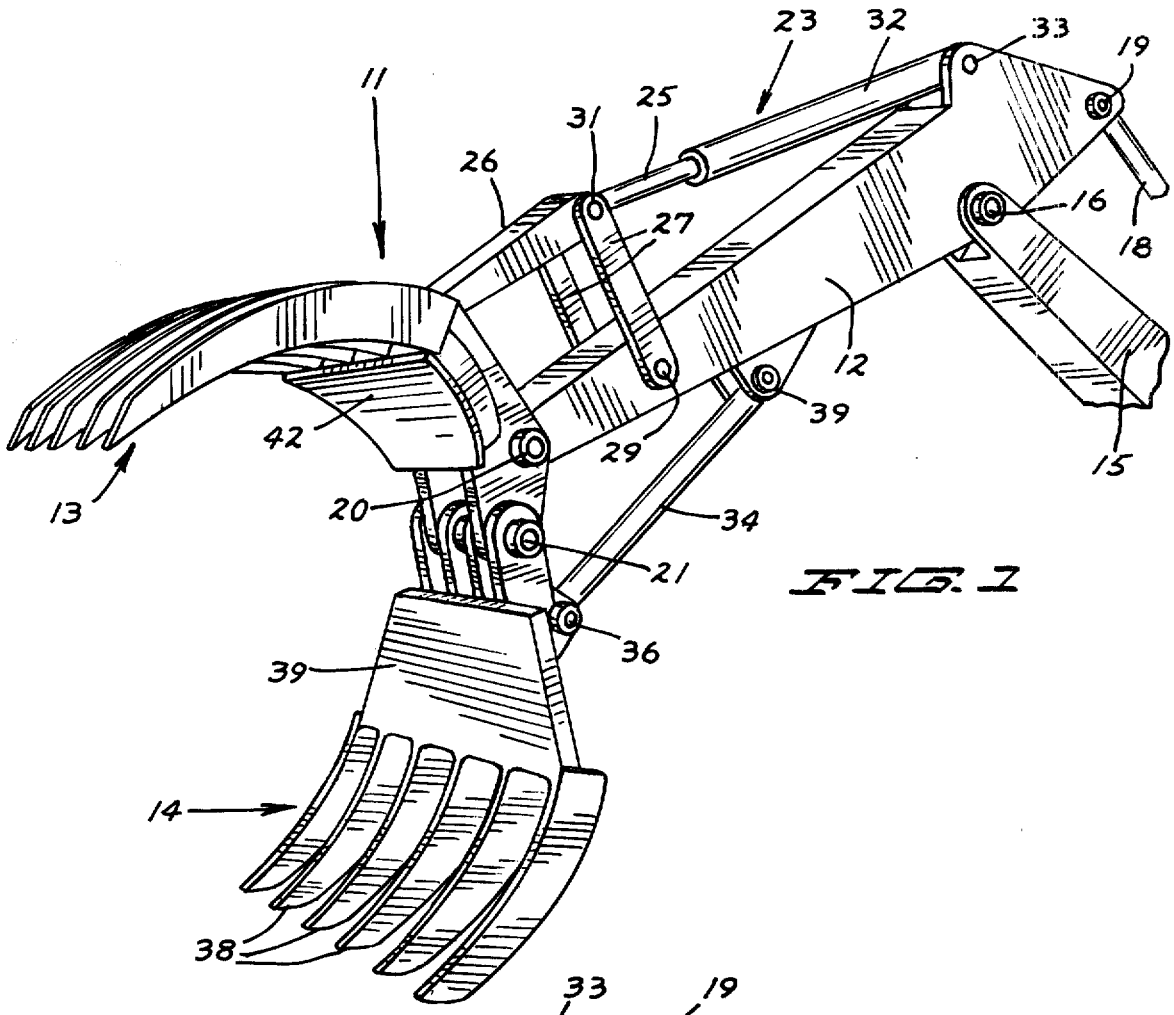
FIG. 1 is a perspective view of the improved grapple assembly of this invention.
Figure 2:
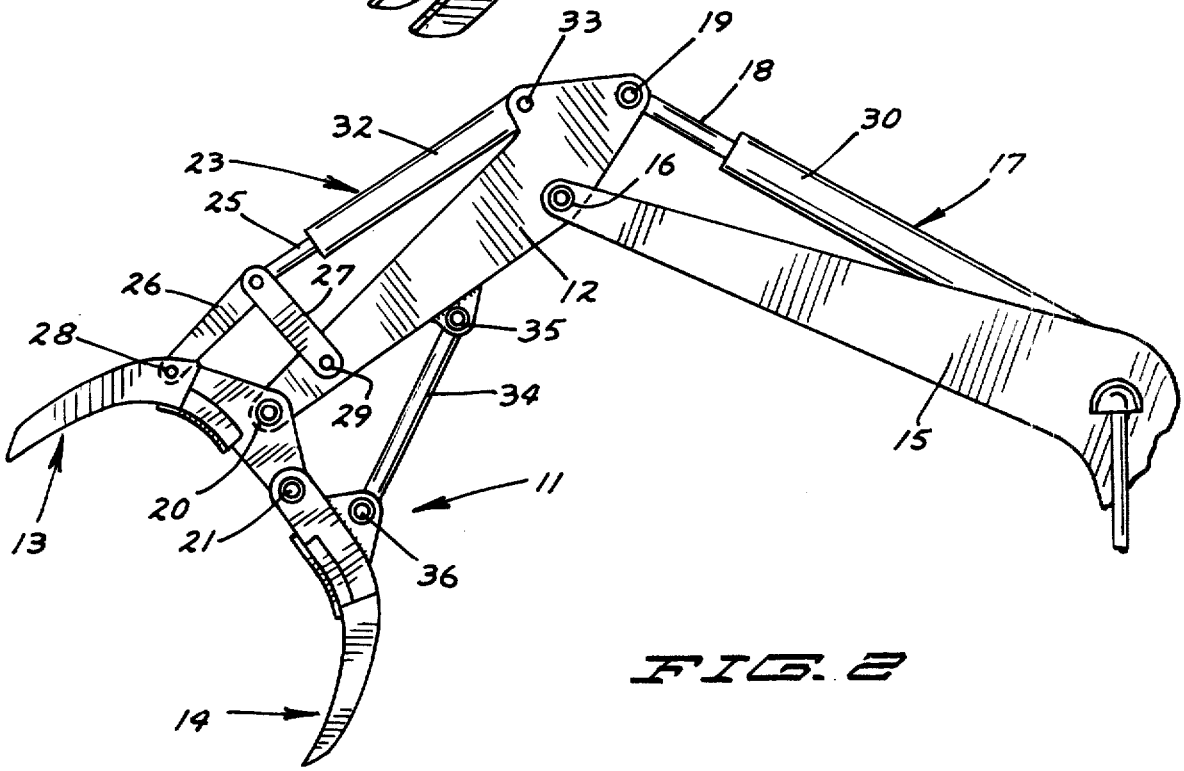
FIG. 2 is a side view of the improved grapple assembly.

Referring to FIGS. 1,2 of the drawing, grapple assembly 11 comprises a stick member 12 and a pair of upper and lower jaws 13, 14, with the inner end of the stick member being pivotally attached to the outer end of boom 15 for pivotal movement about a horizontally extending pivot axis 16. Pivot axis 16 is spaced apart from the inner end of the stick member such that it constitutes a fulcrum and permits the stick member to function as a lever.

Boom 15 is pivotally attached to the swinghouse platform of a conventional backhoe unit comprising a mobile vehicle with endless tracks, the swinghouse being mounted on a turntable and the turntable being mounted to the backhoe chassis. A double-acting hydraulic piston motor (not shown) is operable in conventional manner to control movement of the boom assembly relative to a horizontal axis, as is known in the art. Another double-acting hydraulic piston motor 17 (shown in FIG. 2) has a cylinder 30 and a piston rod 18 pivotally connected to the inner end of stick member 12 at pivot axis 19, to effect movement of stick member 12 relative to axis 19, as is also known in the art.

Upper jaw 13 is pivotally attached at its inner end to end of stick member 12 for pivotal movement about a horizontal pivot axis 20. Lower jaw 14 is pivotally attached at its inner end to the inner end of upper jaw 13 at pivot point 21. Upper jaw 13 is movable to any desired pivoted position by means of a double-acting hydraulic piston motor 23, connected to upper jaw 13 by means of piston rod 25 and control links 26, 27. Links 26, 27 are pivotally connected respectively to stick member 12 and upper jaw 13 at pivot points 28, 29, and to each other at pivot point 31. The outer end of piston rod 25 is pivotally connected at pivot point 31 of links 26, 27, and cylinder 32 of motor 23 is pivotally connected to stick member 12 at pivot point 33.

Lower jaw 14 is connected to stick member 12 by means of rod 34 pivotally secured at its inner end at pivot point 35 and at its outer end at pivot point 36. When upper jaw 13 is pivoted about pivot point 20 in response to the action of hydraulic cylinder 32, lower jaw 14 is caused to pivot about pivot point 21, such that the jaws can be moved toward or away from one another as desired. Rod 34 can be formed of a pair of metal cylinders, one within the other, with slots for the insertion of pins, such that it is adjustable. That is, different pin settings will allow varied open and closed positions for the upper and lower jaws 13, 14. Also, a double-acting hydraulic cylinder piston motor can be substituted for rod 34, to work together with hydraulic cylinder 32 in achieving proper positioning of lower jaw 14.

Lower jaw 14 is generally arc-shaped and formed with a plurality of tines 38 and with end plates 39. Upper jaw 13 is similar in shape and construction to lower jaw 14 but has one less tine, to permit an interleaving action of the tines 41 and end plates 42 of the jaw 13 with the tines and end plates of the jaw 14 when the jaws are brought together during the clamping operation.

In operation of the improved grapple assembly of this invention, a skillful operator can maneuver the boom assembly and stick member for a variety of backhoe operations, including the biting off of portions from a building to be demolished as well as the picking up of objects such as rocks or logs. The bitten off portions or picked up objects can be loaded directly into a load-receiving vehicle without having to move the backhoe itself, and debris which has fallen to the ground can be efficiently recovered by raking the debris with sweeping strokes in an outward direction from the backhoe, using the tines of lower jaw 14.

The improved grapple assembly of this invention is especially advantageous in that it can be used not only for the clamping or "clam" action required for biting off portions of buildings to be demolished, but also because it has much greater flexibility for raking operations. That is, lower jaw 14 can be positioned at any desired angle with respect to the excavator, simply by means of operating the hydraulic cylinder to move upper jaw 13. Movement of upper jaw 13 is continued until it has caused lower jaw 14 to pivot to the desired raking position. Debris closely adjacent the excavator can then be raked or picked up and loaded into a load-receiving vehicle, without having to move the backhoe. Movement of upper jaw 13 can also be used to move lower jaw 14 to an extreme rearward position, thereby enabling the grapple assembly to dump a load of debris with less trouble than is typically found in using conventional grapple assemblies. This allows cleaner dumping, and piling of debris at a greater height.

It is seen that I have invented a new and improved backhoe grapple assembly comprising a pair of upper and lower jaws, with the upper jaw being pivotally connected near its inner end to the outer end of the backhoe stick member and the lower jaw being pivotally attached to the inner end of the upper jaw, the lower jaw being pivotally connected to the stick member, such that movement of the upper jaw by hydraulic means will effect movement of the lower jaw to open or close the jaws as desired.

I claim:

1. An improved grapple assembly for a backhoe of the type having a swinghouse, a boom on the swinghouse pivotal about a horizontal and vertical axis and a forwardly extending stick pivotally mounted on the boom for pivotal movement about a horizontal axis, the grapple assembly comprising an upper grapple jaw pivotally attached near its inner end to the outer end of the stick, a lower grapple jaw pivotally attached at its inner end to the inner end of the upper jaw, hydraulic means pivotally mounted on the stick and operably connected to the upper jaw for effecting pivotal movement of the upper jaw, and pivotal brace means mounted on the stick and pivotally connected to the lower jaw for allowing pivotal movement of the lower jaw in response to movement of the upper jaw.

2. The improved grapple assembly of claim 1 wherein the pivotal means comprises a rigid brace extending from the underside of the stick to a point on the lower jaw between its outer and inner ends, the brace being pivotally connected at each of its ends to allow movement of the brace in response to pivotal movement of the lower jaw.

3. The improved grapple assembly of claim 1 wherein the hydraulic means comprises a double-acting hydraulic cylinder and piston rod and linkage extending from the upper side of the stick to the upper jaw at a point between its inner and outer end.

4. The improved grapple assembly of claim 1 wherein the upper and lower jaws are formed with tines, one of the jaws having one more of said tines than the other to allow interleaving of the tines of said jaws during the clamping operation.

5. The improved grapple assembly of claim 1 wherein the hydraulic means comprises a double-acting hydraulic cylinder pivotally connected at its inner end to the stick and having a piston rod at its outer end pivotally connected by a first link to the upper jaw at a point between the outer end of the jaw and its point of pivotal connection to the stick, with a second link pivotally connected between the stick and the point of pivotal connection of the piston rod and first link.

6. The improved grapple assembly of claim 2 wherein the inner end of the upper jaw extends transversely of the stick between the pivot on the stick and the pivotal attachment between the upper and lower jaws when the jaws are open, and the inner end of the lower jaw extending transversely of the brace between the pivotal connection between the brace and the lower jaw and the pivotal attachment between the upper and lower jaws when the jaws are open.

* * * * *